US009875844B2

(12) United States Patent
Komuro

(10) Patent No.: US 9,875,844 B2
(45) Date of Patent: Jan. 23, 2018

(54) WINDING COMPONENT

(71) Applicant: TDK CORPORATION, Tokyo (JP)

(72) Inventor: Yuka Komuro, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 15/407,603

(22) Filed: Jan. 17, 2017

(65) Prior Publication Data

US 2017/0213640 A1 Jul. 27, 2017

(30) Foreign Application Priority Data

Jan. 26, 2016 (JP) ..... 2016-012016

(51) Int. Cl.

| | |
|---|---|
| ***H01F 27/30*** | (2006.01) |
| ***H01F 27/32*** | (2006.01) |
| ***H01F 27/29*** | (2006.01) |
| ***H01F 27/28*** | (2006.01) |

(52) U.S. Cl.

CPC ..... *H01F 27/324* (2013.01); *H01F 27/2823* (2013.01); *H01F 27/2847* (2013.01); *H01F 27/29* (2013.01); *H01F 27/30* (2013.01); *H01F 27/306* (2013.01)

(58) Field of Classification Search

CPC ..... H01F 27/00–27/36
USPC ..... 336/65, 83, 196, 198, 200, 220–223
See application file for complete search history.

(56) References Cited

U.S. PATENT DOCUMENTS

| | | | | |
|---|---|---|---|---|
| 4,761,629 | A * | 8/1988 | Martin | H01B 17/58 174/138 E |
| 2002/0070836 | A1* | 6/2002 | Fujiyoshi | H01F 27/2852 336/200 |
| 2003/0098769 | A1* | 5/2003 | Cheung | H01F 27/306 336/208 |

FOREIGN PATENT DOCUMENTS

JP 2011-198847 A 10/2011

* cited by examiner

*Primary Examiner* — Tuyen Nguyen
(74) *Attorney, Agent, or Firm* — Greenblum & Bernstein, P.L.C.

(57) ABSTRACT

A winding component includes a core; a frame disposed near the core; and a winding. The frame includes two frame members, which are joined and have openings for inserting the core and guards that face each other. A barrel, which is disposed on an edge of an opening and has the core inserted thereinto, is formed on one frame member, which also includes a separation restricting portion that restricts separation of the frame members and includes: a plate that protrudes from the barrel toward the other frame member and elastically deforms relative to a center of the opening; and a hook which is formed on the plate, protrudes away from the center, and engages the other frame member. When the core is inside the barrel, the plate and the core remain adjacent or in contact, and elastic deformation of the plate toward the center is restricted.

5 Claims, 10 Drawing Sheets

WINDING COMPONENT

FIELD OF THE INVENTION

The present invention relates to a winding component equipped with a core member, a winding frame, and a winding.

DESCRIPTION OF THE RELATED ART

The reactor disclosed in Japanese Laid-open Patent Publication No. 2011-198847 is known as one example of a winding component. This reactor includes a coil member with a pair of coils, a ring-shaped core that is fitted into both coils, and a reactor bobbin interposed between the coil member and the ring-shaped core. The reactor bobbin is formed by combining a first split piece and a second split piece. Engagement portions are formed on the trunk parts of the first split piece and the second split piece, which are configured so that when the first split piece and the second split piece are brought together along the axial direction to place the respective engaging portions into engagement, the split parts do not become separated in the axial direction.

SUMMARY OF THE INVENTION

However, by investigating the reactor described above, the present inventors discovered the following problem. That is, with the reactor described above, the engaging portions are brought into engagement by bringing the first split part and the second split part together along the axial direction. Also, with the above reactor, the coil member is disposed so as to fit between the frame portions of the reactor bobbin which has been formed by combining the first split piece and the second split piece. Here, since the coil member is configured by winding rectangular copper wire that has an insulating covering into a spiral, when the coil member is disposed on the reactor bobbin, there are cases where an elastic force is produced in the extension direction due to the coil member being pressed in a shortening direction (compression direction) by the frame portions of the reactor bobbin. With this reactor, the elastic force of the coil member acts upon the frame portions of the first split piece and the second split piece so that the first split piece and the second split piece are pressed along the axial direction in opposite (i.e., separating) directions, resulting in the problem of a risk that the engagement between the engagement portions will be released and the first split piece and the second split piece will become separated.

The present invention was conceived in view of the problem described above and it is a principal object of the present invention to provide a winding component where the joined state of a pair of winding frame members that construct a winding frame can be reliably maintained.

To achieve the stated object, a winding component according to the present invention comprises a core member; a winding frame disposed in a vicinity of the core member; and a winding formed by one or more conductors that wind around the winding frame, wherein the winding frame includes a pair of winding frame members which are configured so as to be capable of being joined together, which each have an opening through which the core member is inserted formed therein, and each have a guard portion provided so that the guard portions face each other in a joined state which is produced when the winding frame members are joined together, a barrel-shaped portion, which is disposed on an edge of the opening and is capable of having the core member inserted thereinto, is formed on one of the winding frame members, the one of the winding frame members is equipped with a first separation restricting portion that restricts separation of the winding frame members in the joined state and includes: a first plate-shaped portion which is disposed so as to protrude from a front end of the barrel-shaped portion toward the other winding frame member in a direction perpendicular to the guard portion and which is capable of elastic deformation in a direction toward and away from a center axis of the opening; and a first hook portion that is formed on a front end of the first plate-shaped portion so as to protrude in a direction away from the center axis and engages the other winding frame member in the joined state, and the first separation restricting portion is configured so that one state out of a contacting state and an adjacent state between the first plate-shaped portion and the core member is maintained when the core member has been inserted into the barrel-shaped portion and elastic deformation of the first plate-shaped portion in a direction toward the center axis is restricted.

According to the winding component, it is possible to reliably prevent a situation where engagement of the hook portion on one of winding frame members is released, which makes it possible to reliably maintain the joined state of each winding frame member. Also, according to the winding component, by disposing the separation restricting portions on the front ends of the barrel-shaped portions, it is possible, by merely inserting the barrel-shaped portions into the opening of one of the winding frame members when each winding frame member is joined, to have the first hook portions formed on the front ends of the first plate-shaped portions of the first separation restricting portions engage the first winding frame member. This means that it is possible to easily assemble the winding component and to sufficiently raise the efficiency with which the winding component can be assembled.

Also, in case of the winding component according to the present invention, wherein a plurality of openings that face one another in the joined state are formed in the pair of winding frame members, the barrel-shaped portion on which the first separation restricting portion is provided is disposed on an edge of one or more openings out of the plurality of openings in the one winding frame member, the barrel-shaped portion is provided on an edge of each opening of the other winding frame member that faces openings of the one winding frame member aside from the one or more openings, and a second separation restricting portion is disposed on the other winding frame member, wherein the second separation restricting portion restricting separation of the winding frame members in the joined state and including: a second plate-shaped portion that is disposed so as to protrude in a direction perpendicular to the guard portion from a front end of the barrel-shaped portion disposed on the other winding frame member toward the one winding frame member and is capable of elastic deformation toward and away from a center axis of the opening; and a second hook portion that is formed on a front end of the second plate-shaped portion so as to protrude in a direction away from the center axis and engages the one winding frame member in the joined state, and the second separation restricting portion is configured so that one state out of a contacting state and an adjacent state between the second plate-shaped portion and the core member is maintained when the core member has been inserted into the barrel-shaped portion and elastic deformation of the second plate-shaped portion in a direction toward a center axis is restricted.

According to the winding component, since it is possible, when a force is applied in a direction where the winding frame members become separated with each other, to distribute such force with favorable balance between the separation restricting portions, it is possible to reliably prevent a situation where the engagement of the first hook portion and the second hook portion is released.

Also, the winding component according to the present invention, wherein the barrel-shaped portions are formed on both the winding frame members and are configured so that respective barrel-shaped portions are capable of being inserted in one another.

According to the winding component, compared to a configuration where barrel-shaped portions are formed on only one of the winding frame members, it is possible to make the creepage distance between the core member and the winding sufficiently long, which makes it possible to sufficiently improve the insulation between the core member and the winding.

Also, a winding component according to the present invention comprises a core member; a winding frame disposed in a vicinity of the core member; and a winding formed by one or more conductors that wind around the winding frame, wherein the winding frame includes a pair of winding frame members which are configured so as to be capable of being joined together, which each have an opening through which the core member is inserted formed therein, and each have a guard portion provided so that the guard portions face each other in a joined state which is produced when the winding frame members are joined together, a barrel-shaped portion, which is disposed on an edge of the opening and is capable of having the core member inserted thereinto, is formed on one of the winding frame members, another of the winding frame members is equipped with a separation restricting portion that restricts separation of the winding frame members in the joined state and includes: a plate-shaped portion which is disposed so as to protrude from an edge of the opening toward the one of the winding frame members in a direction perpendicular to the guard portion and which is capable of elastic deformation in a direction toward and away from a center axis of the opening; and a hook portion that is formed on a front end of the plate-shaped portion so as to protrude in a direction away from the center axis and engages the one of winding frame members in the joined state, and the separation restricting portion is configured so that one state out of a contacting state and an adjacent state between the plate-shaped portion and the core member is maintained when the core member has been inserted into the barrel-shaped portion and elastic deformation of the plate-shaped portion in a direction toward the center axis is restricted.

According to the winding component, since it is possible to reliably prevent the engagement of the hook portions on one of the winding frame members from being released, it is possible to reliably maintain the joined state of the winding frame members. Also, according to the winding component, by disposing the separation restricting portions on the edges of the openings of the guard portion of the winding frame member on which barrel-shaped portions are not formed, it is possible to have the hook portions formed on the front ends of the plate-shaped portions of the separation restricting portions engage one of the winding frame members by merely inserting the separation restricting portions into the barrel-shaped portions of one of the winding frame members when joining the winding frame members. This means that it is possible to easily assemble the winding component and to sufficiently raise the efficiency with which the winding component can be assembled.

It should be noted that the disclosure of the patent invention relates to the contents of Japanese Patent application 2016-12016 that was filed on Jan. 26, 2016, the entire contents of which are herein incorporated by reference.

BRIEF DESCRIPTION OF THE DRAWINGS

These and other objects and features of the present invention will be explained in more detail below with reference to the attached drawings, wherein.

DESCRIPTION OF THE PREFERRED EMBODIMENTS

Preferred embodiments of a winding component will now be described with reference to the attached drawings.

Figure 1:
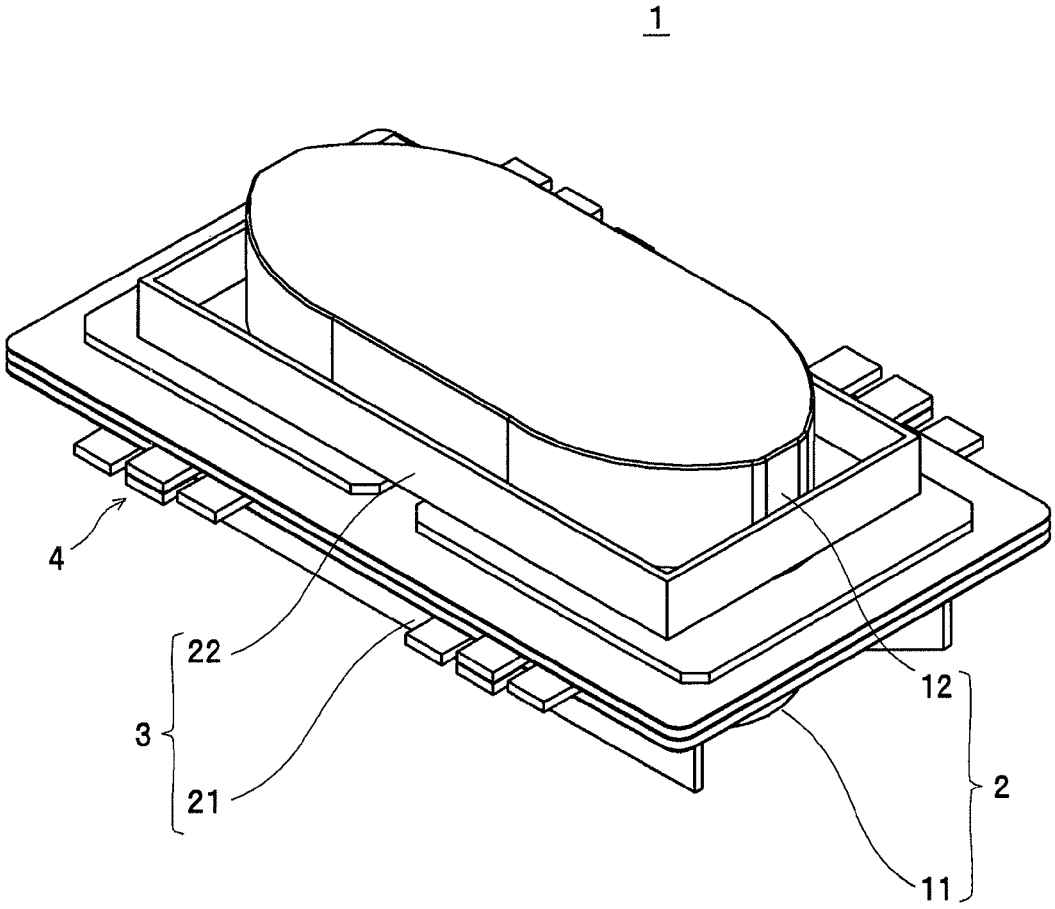
FIG. 1 is a perspective view of a winding component in a state where a second core member faces upward.

First, the configuration of a winding component 1 depicted in FIG. 1 will be described as an example of a winding component. As depicted in FIG. 1 and FIGS. 2 to 4, the winding component 1 includes a core member 2, a winding frame 3, a winding 4, and separation restricting portions 5 (which correspond to a "first separation restricting portion" for the present invention).

Figure 2:
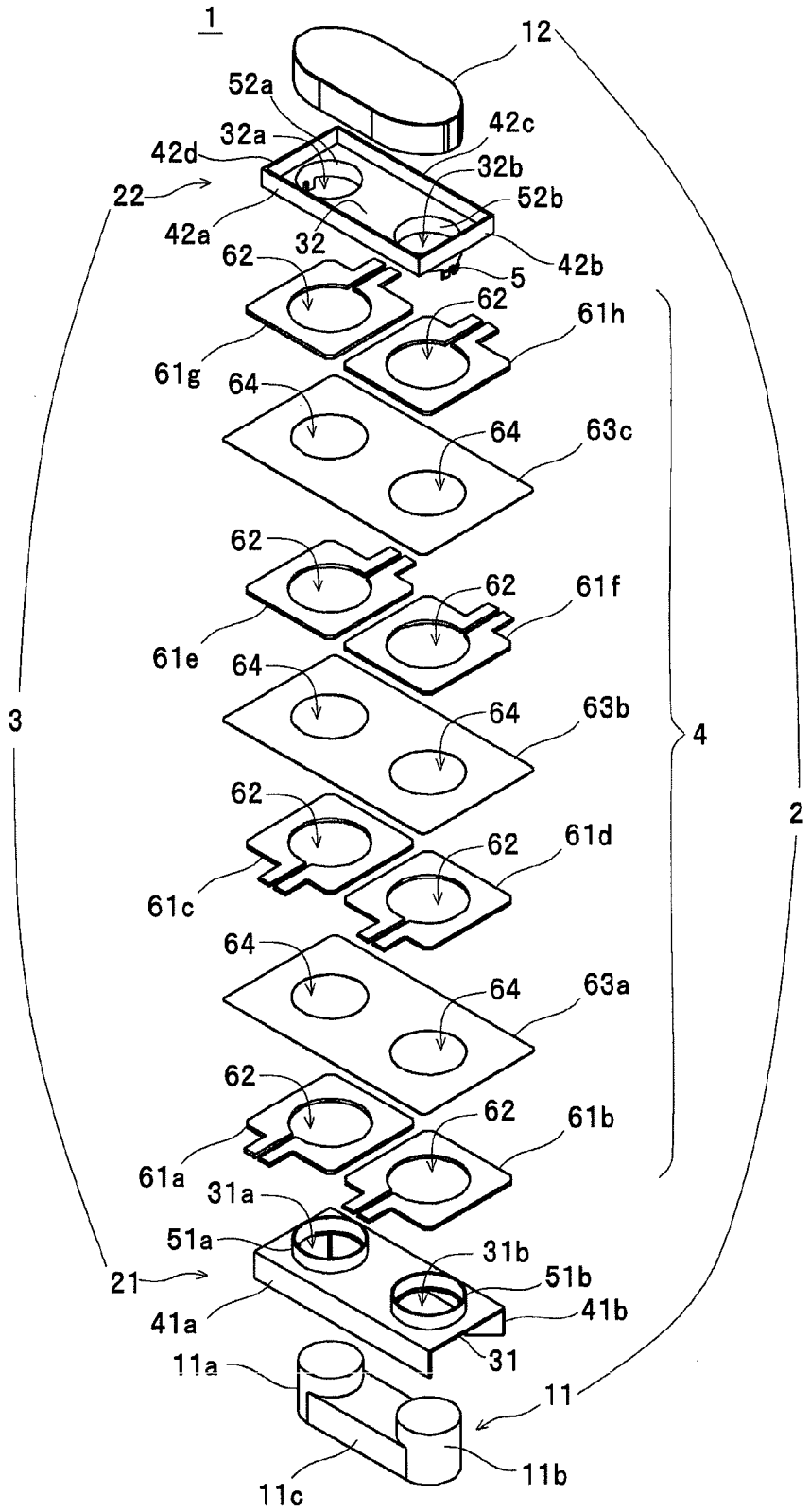
FIG. 2 is an exploded perspective view of the winding component in a state where the second core member faces upward.
Figure 3:
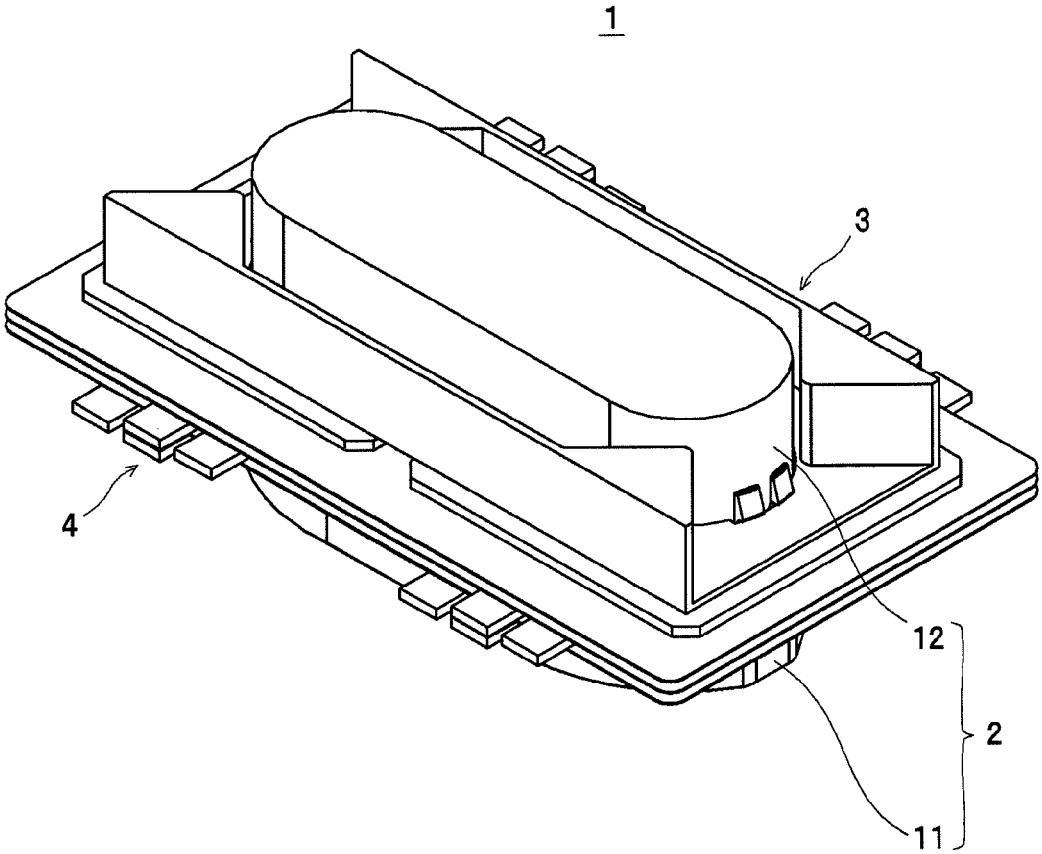
FIG. 3 is a perspective view of a winding component in a state where a first core member faces upward.

As one example, the core member 2 is a so-called "UI" core member and as depicted in FIGS. 1 to 4, includes a first core member 11 and a second core member 12. The first core member 11 is a U-shaped core member formed of a magnetic material and, as depicted in FIG. 2, includes a pair of pillar portions 11*a* and 11*b* that are formed in cylindrical shapes and a plate-shaped portion 11*c* that connects the pillar portions 11*a* and 11*b* and is in the form of an oval (rounded rectangular) plate when viewed from above. The second core member 12 is an I-shaped core member formed of a magnetic material and, as depicted in the drawings, is in the form of an oval (rounded rectangle) when viewed from above.

Figure 4:
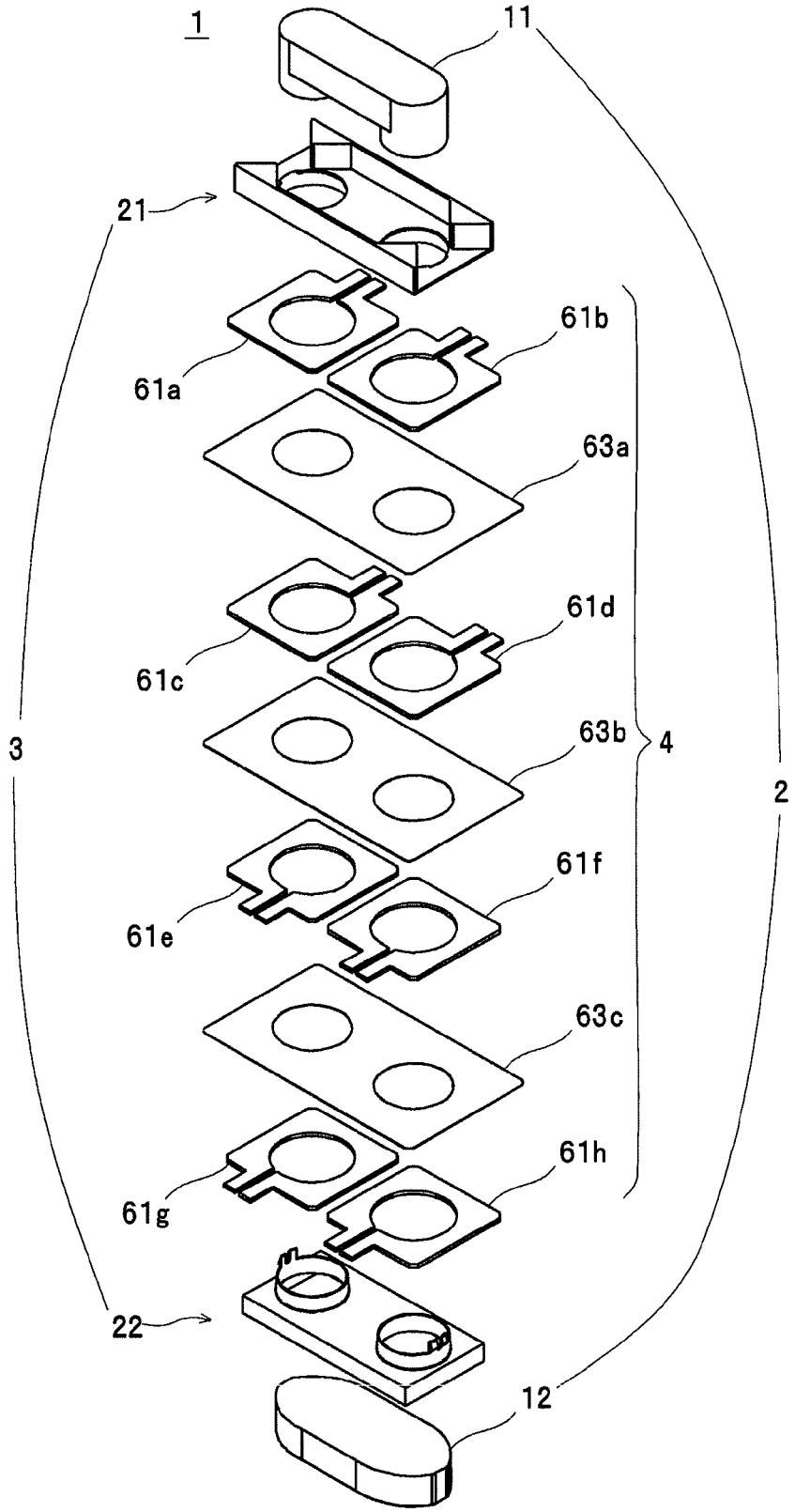
FIG. 4 is an exploded perspective view of the winding component in a state where the first core member faces upward.

As depicted in FIGS. 1, 2, and 4, the winding frame 3 includes a first winding frame member 21 and a second winding frame member 22 that are both formed of an insulating material (such as resin) and can be joined together.

Figure 6:
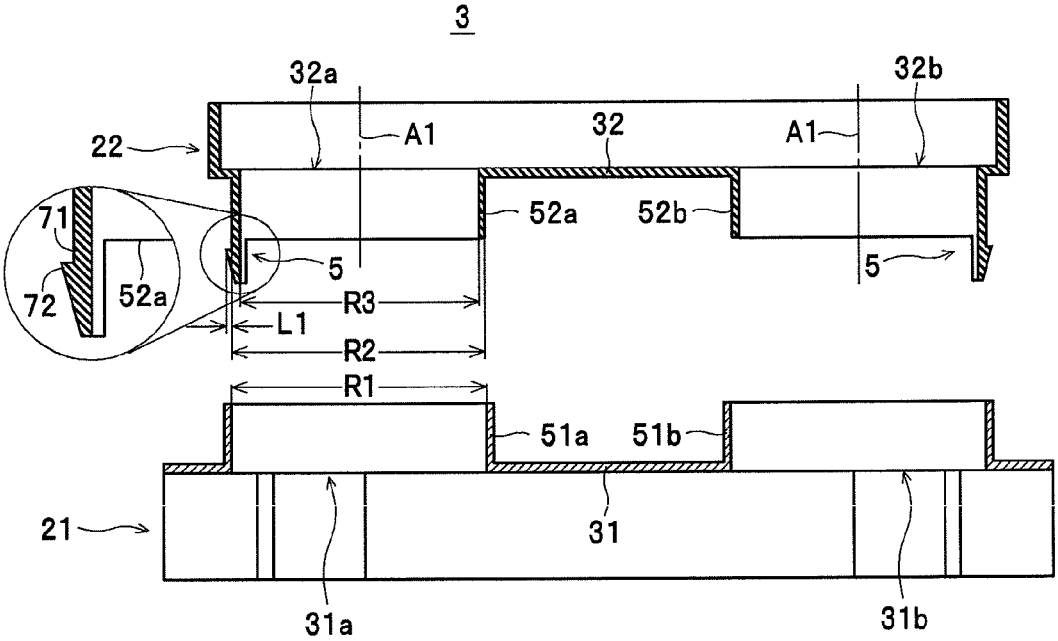
FIG. 6 is a cross-sectional view depicting the configuration of a winding frame.

As depicted in FIG. 2, the first winding frame member 21 includes a guard portion 31 formed as a rectangular plate, and side plates 41*a* and 41*b* that are erected on the pair of edges in the length direction of the guard portion 31. Two openings 31*a* and 31*b* that are circular and through which the pillar portions 11*a* and 11*b* of the first core member 11 of the core member 2 can be inserted are formed in the guard portion 31. Barrel-shaped portions 51*a* and 51*b* (depicted in FIG. 2 and hereinafter collectively referred to as the "barrel-shaped portions 51 " when no distinction is made), described later, into which barrel-shaped portions 52*a* and 52*b* (hereinafter collectively referred to as the "barrel-shaped portions 52" when no distinction is made), described later, of the second winding frame member 22 can be inserted are respectively formed on the edges of the openings 31*a* and 31*b* of the guard portion 31. Here, as depicted in FIG. 6, the inner diameter R1 of the barrel-shaped portions 51 is set so as to be larger than the outer diameter R2 of the barrel-shaped portions 52 and smaller than a length produced by adding a protruding length L1 of a hook portion 72, described later, provided on a separation restricting portion 5 to the outer diameter R2 of the barrel-shaped portions 52. Note that in FIG. 6, a state is depicted where the first winding frame member 21 and the second winding frame member 22 have been cut along the length direction (a direction from top left to bottom right in FIGS. 1 and 3), one separation restricting portion 5 disposed on the barrel-shaped portion 52*a* has been cut along a direction that passes the center in the width direction of this separation restricting portion 5 and a center axis A1 of the barrel-shaped portion 52*a*, and one separation restricting portion 5 disposed on the barrel-shaped portion 52*b* has been cut along a direction that passes the center in the width direction of this separation restricting portion 5 and a center axis A1 of the barrel-shaped portion 52*b*.

Figure 5:
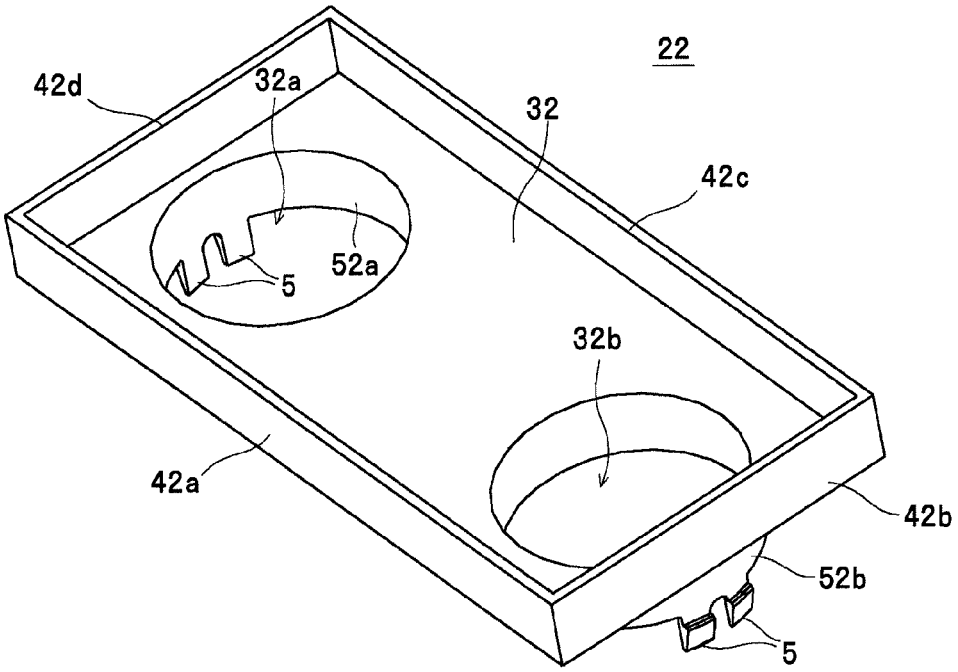
FIG. 5 is a perspective view of a second winding frame member.

As depicted in FIGS. 2 and 5, the second winding frame member 22 includes a guard portion 32 formed as a rectangular plate, and side plates 42*a* to 42*d* that are erected on the respective edges of the guard portion 32. Two openings 32*a* and 32*b* that are circular and through which the pillar portions 11*a* and 11*b* of the first core member 11 of the core member 2 can be inserted are formed in the guard portion 32. The barrel-shaped portions 52*a* and 52*b* into which the pillar portions 11*a* and 11*b* of the first core member 11 can be inserted are respectively formed on the edges of the openings 32*a* and 32*b* of the guard portion 32. In this embodiment, the guard portion 31 and 32 that are formed in the shape of a flat plate, but it is not limited thereto and any shape may be used. Here, the inner diameter R3 (see FIG. 6) of the barrel-shaped portions 52 is set slightly larger than an outer diameter R4 (see FIG. 11) of the pillar portions 11*a* and 11*b*. The inner diameter R3 of the barrel-shaped portions 52 is also set so that the difference between the inner diameter R3 and the outer diameter R4 is smaller than the protruding length L1 of the hook portion 72 mentioned above.

Figure 10:
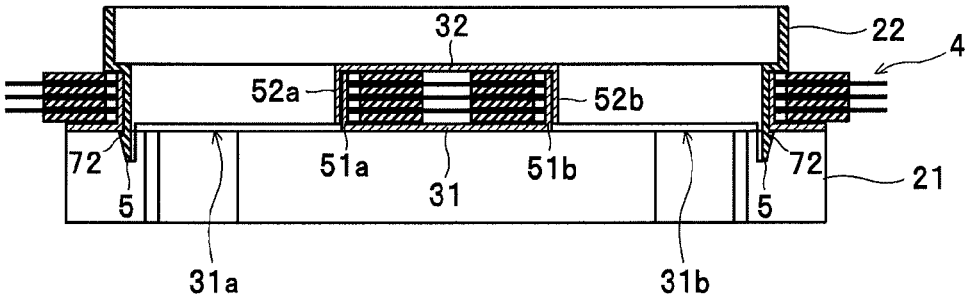
FIG. 10 is a fourth diagram useful in explaining a method of assembling the winding component.

As depicted in FIG. 10, the winding component 1 is configured so that in a joined state where the first winding frame member 21 and the second winding frame member 22 have been joined, the guard portion 31 of the first winding frame member 21 and the guard portion 32 of the second winding frame member 22 face one another in a parallel state.

As depicted in FIGS. 2 and 4, the winding 4 includes conductors 61*a* to 61*h* (collectively referred to as the "conductors 61" when no distinction is made) and insulating sheets 63*a* to 63*c* (collectively referred to as the "insulating sheets 63" when no distinction is made). Also, as depicted in FIG. 2, through-holes 62 through which the barrel-shaped portions 51 of the first winding frame member 21 and the barrel-shaped portions 52 of the second winding frame member 22 can be inserted are formed in the conductors 61 and through-holes 64 through which the barrel-shaped portions 51 and 52 can be inserted are formed in the insulating sheets 63.

The conductors 61 are stacked in a state where the respective conductors 61 are insulated from each other by the insulating sheets 63 that are interposed therebetween. By connecting the conductors 61*a*, 61*c*, 61*e*, and 61*g* using a connecting conductor, not depicted, so as to form a spiral, a winding (coil) that winds around the barrel-shaped portion 51*a* of the first winding frame member 21 and the barrel-shaped portion 52*a* of the second winding frame member 22 is constructed. Similarly, by connecting the conductors 61*b*, 61*d*, 61*f*, and 61*h* using a connecting conductor, not depicted, so as to form a spiral, a winding (coil) that winds around the barrel-shaped portion 51*b* of the first winding frame member 21 and the barrel-shaped portion 52*b* of the second winding frame member 22 is constructed.

The separation restricting portions 5 function so as to restrict separation of the first winding frame member 21 and the second winding frame member 22 in a joined state (i.e., the state depicted in FIG. 10) and, as depicted in FIG. 5, are disposed on the second winding frame member 22 (one example of "one of the winding frame members"). Here, for the winding component 1, as depicted in FIG. 5, four separation restricting portions 5 are provided. Also, as depicted in FIG. 6, each separation restricting portion 5 includes the plate-shaped portion 71 (corresponding to a "first plate-shaped portion" for the present invention) and a hook portion 72 (corresponding to a "first hook portion" for the present invention).

As depicted in FIG. 6, the plate-shaped portion 71 is disposed on a front end of the barrel-shaped portion 52*a* of the second winding frame member 22 so as to protrude from the front end of the barrel-shaped portion 52*a* toward the first winding frame member 21 (the "other winding frame member in the joined state") in a direction (downward in FIG. 6) that is perpendicular to the guard portion 32. The plate-shaped portion 71 is integrally formed with the second winding frame member 22 using the same material (resin) as the second winding frame member 22, and is capable of elastic deformation in (inward and outward) directions toward and away from the center axes A1 of the openings 32*a* and 32*b* (the barrel-shaped portions 52) of the second winding frame member 22. Also, as depicted in the drawings, the plate-shaped portion 71 has an arc-shaped cross-sectional form with a radius of curvature equal to the radius of the barrel-shaped portions 52, is formed with the same thickness as the barrel-shaped portions 52 (see FIG. 5), and is formed so that an outer surface is flush with the outer circumferential surface of a barrel-shaped portion 52 and an inner surface is flush with the inner circumferential surface of the barrel-shaped portion 52.

As depicted in FIG. 6, the hook portion 72 is formed on the front end of the plate-shaped portion 71 so as to protrude in a (outward) direction away from the center axes A1 of the openings 32*a* and 32*b*. The hook portion 72 also has an arc-shaped cross-sectional form (see FIG. 5). Here, as depicted in FIG. 6, the protruding length L1 by which the hook portion 72 protrudes from outer surface of the plate-shaped portion 71 is set so as to be larger than a length produced by subtracting the outer diameter R2 of the barrel-shaped portions 52 of the second winding frame member 22 from the inner diameter R1 of the barrel-shaped portions 51 of the first winding frame member 21, or in other words, the maximum width of a gap between the inner circumferential surface of the barrel-shaped portions 51 and the outer circumferential surface of the barrel-shaped portions 52 when the barrel-shaped portions 52 have been inserted into the barrel-shaped portions 51. Also, as described above, since the plate-shaped portion 71 has an arc-shaped cross-sectional form and is formed so that the outer surface is flush with the outer circumferential surface of the barrel-shaped portions 52 and the hook portion 72 has an arc-shaped cross-sectional form, the relationship described above about the protruding length L1 being larger than the length produced by subtracting the outer diameter R2 from the inner diameter R2 is satisfied for at every position on the hook portion 72.

Next, the method of assembling the winding component 1 will be described with reference to the drawings.

Figure 7:
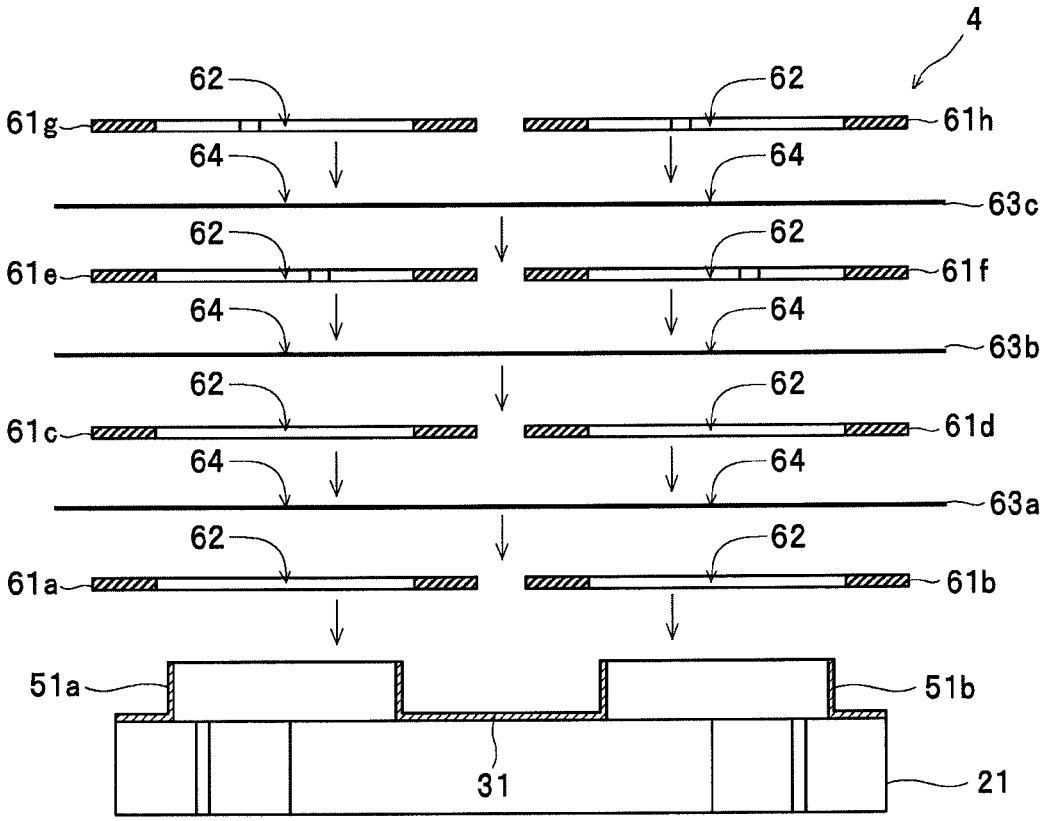
FIG. 7 is a first diagram useful in explaining a method of assembling the winding component.
Figure 8:
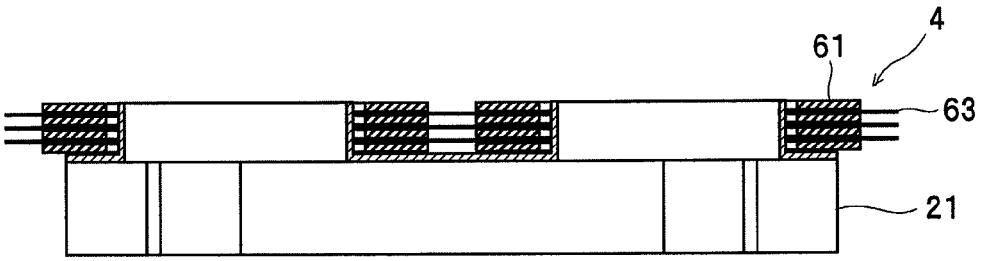
FIG. 8 is a second diagram useful in explaining a method of assembling the winding component.

First, as depicted in FIG. 7, the conductors 61 and the insulating sheets 63 are mounted on the guard portion 31 of the first winding frame member 21 while inserting the barrel-shaped portions 51*a* and 52*b* of the first winding frame member 21 that constructs the winding frame 3 through the through-holes 62 of the conductors 61 and the through-holes 64 of the insulating sheets 63. By doing so, as depicted in FIG. 8, the conductors 61 are stacked in a state where the respective conductors 61 are insulated from each other by the insulating sheets 63 interposed therebetween.

Figure 9:
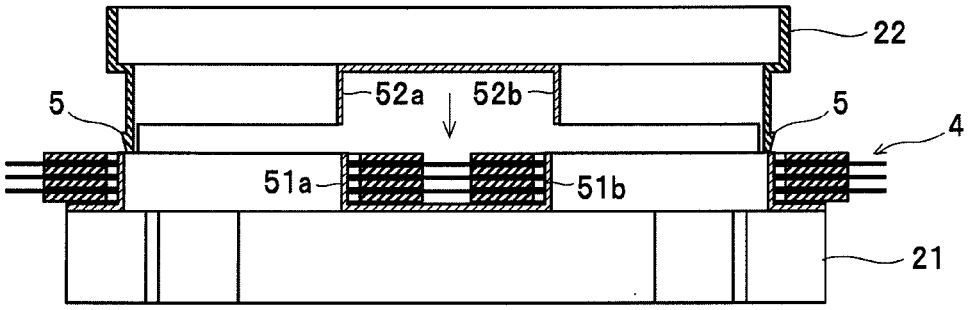
FIG. 9 is a third diagram useful in explaining a method of assembling the winding component.

Next, the first winding frame member 21 and the second winding frame member 22 are joined. More specifically, as depicted in FIG. 9, the separation restricting portions 5 disposed on the front ends of the barrel-shaped portions 52 of the second winding frame member 22 are inserted inside the barrel-shaped portions 51 of the first winding frame member 21 and then the second winding frame member 22 is brought closer to the first winding frame member 21. As depicted in FIG. 6, the hook portions 72 of the separation restricting portions 5 protrude outward with the protruding length L1 that is set so as to be longer than the length produced by subtracting the outer diameter R2 of the barrel-shaped portions 52 from the inner diameter R1 of the barrel-shaped portions 51 (that is, the outer ends of the hook portions 72 will be positioned further outside than the inner surfaces of the barrel-shaped portions 51). This means that when the separation restricting portions 5 are inserted inside the barrel-shaped portions 51, the hook portions 72 are pressed by the barrel-shaped portions 51 in a (inward) direction toward the center axis A1 (see FIG. 6) of the openings 32*a* and 32*b* (the barrel-shaped portions 52) so that the plate-shaped portions 71 elastically deform in this direction.

Next, as depicted in FIG. 10, the second winding frame member 22 is brought even closer to the first winding frame member 21 so that the respective barrel-shaped portions 52 are inserted inside the respective barrel-shaped portions 51. Next, when the hook portions 72 of the separation restricting portions 5 have been inserted through the openings 31*a* and 31*b* of the first winding frame member 21 and become positioned on the rear surface-side of the guard portion 31 (the opposite side to the side where the barrel-shaped portions 51 are formed), the pressing force of the barrel-shaped portions 51 on the hook portions 72 is released, the plate-shaped portions 71 spring back in a (outward) direction away from the center axis A1 (see FIG. 6) of the openings 32*a* and 32*b* (the barrel-shaped portions 52) so that the hook portions 72 move in this direction. As a result, as depicted in FIG. 10, the hook portions 72 engage the edges of the openings 31*a* and 31*b* of the guard portion 31. In this way, the first winding frame member 21 and the second winding frame member 22 are joined. Also, by having the hook portions 72 engage the edges of the openings 31*a* and 31*b* of the guard portion 31, separation of the first winding frame member 21 and the second winding frame member 22 in the joined state is restricted.

Figure 11:
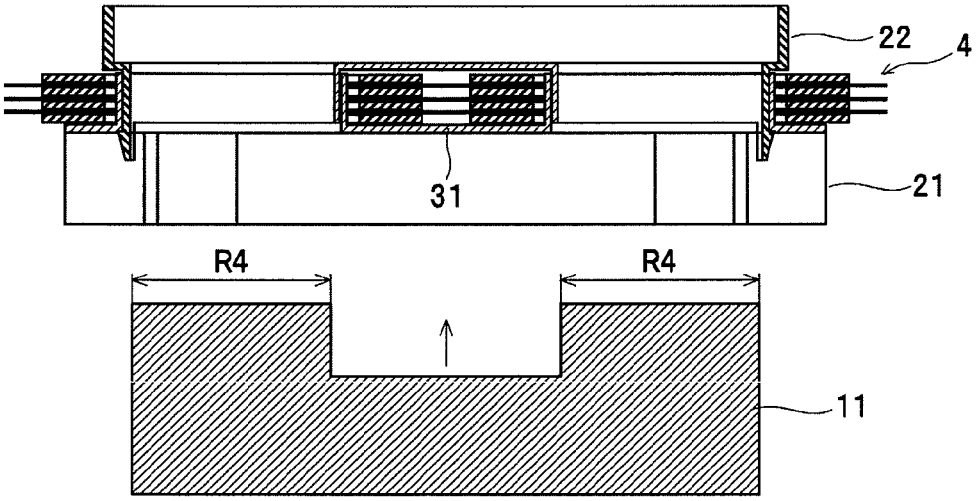
FIG. 11 is a fifth diagram useful in explaining a method of assembling the winding component.

Next, the core member 2 is incorporated. More specifically, as depicted in FIG. 11, the first core member 11 is brought close to the first winding frame member 21 from a lower surface of the guard portion 31-side of the first winding frame member 21, and as depicted in FIG. 12, the pillar portions 11*a* and 11*b* of the first core member 11 are respectively inserted into the barrel-shaped portions 51*a* and 51*b* of the first winding frame member 21 and the barrel-shaped portions 52*a* and 52*b* of the second winding frame member 22.

Here, with the winding component 1, as described above, the inner diameter R3 of the barrel-shaped portions 52 is set slightly larger than the outer diameter R4 of the pillar portions 11*a* and 11*b*. This means that by inserting the pillar portions 11*a* and 11*b* of the first core member 11 into the barrel-shaped portions 52, a state where the inner surfaces of the plate-shaped portions 71 of the separation restricting portions 5 and the outer circumferential surfaces of the pillar portions 11*a* and 11*b* of the first core member 11 are adjacent (one example of "one state out of a contacting state and an adjacent state") is maintained. By doing so, elastic deformation of the plate-shaped portions 71 in a direction toward the center axes A1 of the openings 32*a* and 32*b* (the barrel-shaped portions 52) is restricted. This means that with the winding component 1, a situation where engagement of the hook portion 72 with the edges of the openings 31*a* and 31*b* of the guard portion 31 is released (a state where the hook portions 72 come off the edges) is reliably avoided, which makes it possible to reliably maintain the joined state of the first winding frame member 21 and the second winding frame member 22.

Also, as described above, with the winding component 1, the difference between the inner diameter R3 of the barrel-shaped portions 52 and the outer diameter R4 of the pillar portions 11*a* and 11*b* is set smaller than the protruding length L1 of the hook portions 72. This means that with the winding component 1, it is possible, even when the first core member 11 moves toward the second winding frame member 22 by a length equivalent to the difference between the inner diameter R3 of the barrel-shaped portions 52 and the outer diameter R4 of the pillar portions 11*a* and 11*b*, that is, the maximum width of the gap between the inner circumferential surfaces of the barrel-shaped portions 52 and the outer circumferential surfaces of the pillar portions 11*a* and 11*b* and/or the plate-shaped portions 71 elastically deform in a direction toward the center axes A1 of the openings 32*a* and 32*b* (the barrel-shaped portions 52) by a length equivalent to such distance (the maximum width of the gap), to reliably prevent a situation where the engagement of the hook portions 72 with the edges of the openings 31*a* and 31*b* of the guard portion 31 is released (a situation where the hook portions 72 come off the edges).

Figure 12:
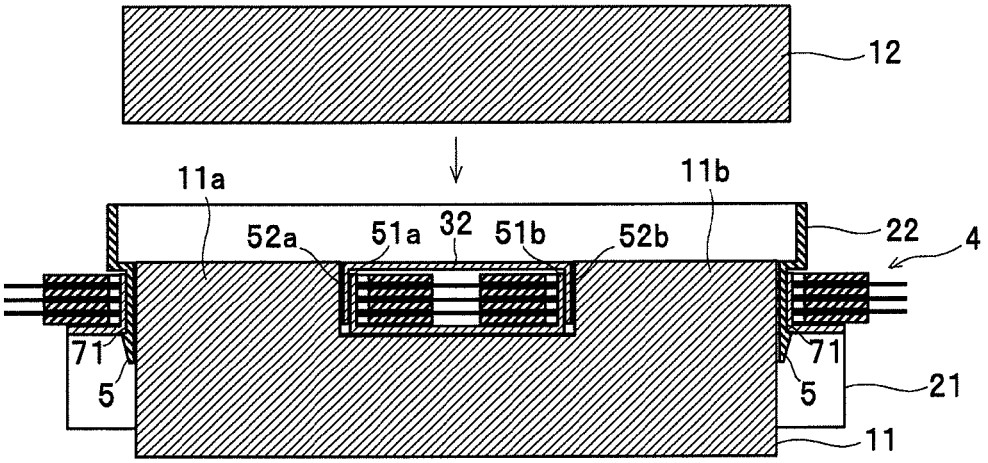
FIG. 12 is a sixth diagram useful in explaining a method of assembling the winding component.
Figure 13:
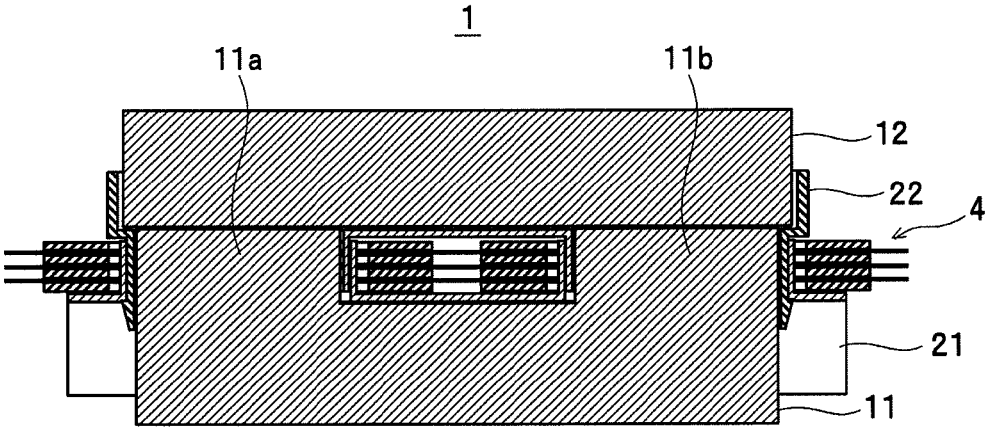
FIG. 13 is a seventh diagram useful in explaining a method of assembling the winding component.

After this, as depicted in FIG. 12, the second core member 12 is brought close to the second winding frame member 22 from an upper surface of the guard portion 32-side of the second winding frame member 22 and as depicted in FIG. 13, the lower surface of the second core member 12 is placed in contact with the front ends of the pillar portions 11*a* and 11*b* of the first core member 11 so that the first core member 11 and the second core member 12 are joined. When doing so, by applying adhesive between the pillar portions 11*a* and 11*b* of the first core member 11 and the second core member 12 or wrapping adhesive tape around an outer circumference of the first core member 11 and the second core member 12, the first core member 11 and the second core member 12 are fixed in the joined state. Next, windings (coils) are constructed by connecting the conductors 61. This completes the assembly of the winding component 1.

In this way, the winding component 1 includes the separation restricting portions 5 that are equipped with the plate-shaped portions 71, which are constructed so as to be capable of elastic deformation in directions toward and away from the center axes A1 of the openings 32*a* and 32*b*, and the hook portions 72, which are formed on the front ends of the plate-shaped portions 71 so as to protrude in directions away from the center axes A1, that are disposed on the barrel-shaped portions 52 and configured so as to be capable of restricting separation of the first winding frame member 21 and the second winding frame member 22 in the joined state, and are configured so that a state where the plate-shaped portions 71 and the pillar portions 11*a* and 11*b* of the first core member 11 that have been inserted in the barrel-shaped portions 52 are adjacent is maintained and elastic deformation of the plate-shaped portions 71 in a direction toward the center axes A1 is restricted. This means that according to the winding component 1, it is possible to reliably prevent a situation where engagement of the hook portion 72 on the first winding frame member 21 is released, which makes it possible to reliably maintain the joined state of the first winding frame member 21 and the second winding frame member 22. Also, according to the winding component 1, by disposing the separation restricting portions 5 on the front ends of the barrel-shaped portions 52, it is possible, by merely inserting the barrel-shaped portions 52 into the barrel-shaped portions 51 (the openings 31*a* and 31*b*) of the first winding frame member 21, to have the hook portions 72 formed on the front ends of the plate-shaped portions 71 of the separation restricting portions 5 engage the first winding frame member 21 (the edges of the openings 31*a* and 31*b*). This means that it is possible to easily assemble the winding component 1 and to sufficiently raise the efficiency with which the winding component 1 can be assembled.

Also, according to the winding component 1, by using a configuration where the barrel-shaped portions 51 and 52 are formed on both the first winding frame member 21 and the second winding frame member 22 and the barrel-shaped portions 52 can be inserted in the barrel-shaped portions 51, compared to a configuration where barrel-shaped portions (the barrel-shaped portions 51 or the barrel-shaped portions 52) are formed on only one of the first winding frame member 21 and the second winding frame member 22, it is possible to make the creepage distance between the core member 2 (the pillar portions 11*a* and 11*b*) and the winding 4 (the conductors 61) sufficiently long, which makes it possible to sufficiently improve the insulation between the core member 2 and the winding 4.

Note that the winding component is not limited to the configuration of the winding component 1 described above. Although in the winding component 1 described above, the second winding frame member 22 is set as the "one of the winding frame members" for the present invention, it is also possible to set the first winding frame member 21 as the "one of the winding frame members". In this way, when the first winding frame member 21 is set as the "one of the winding frame members", the plate-shaped portions 71 of the separation restricting portions 5 are formed on the front ends of the barrel-shaped portions 51 of the first winding frame member 21. With this configuration, the inner diameter of the barrel-shaped portions 51 is set as the inner diameter R3 described above and the outer diameter of the barrel-shaped portions 51 is set as the outer diameter R2 described above. Also with this configuration, the inner diameter of the barrel-shaped portions 52 is set as the inner diameter R1 described above.

Although an example where the barrel-shaped portions 51 and 52 are formed on both the first winding frame member 21 and the second winding frame member 22 has been described above, it is also possible to use a configuration where barrel-shaped portions are formed on only the single winding frame member, out of the first winding frame member 21 and the second winding frame member 22, on which the separation restricting portions 5 are disposed.

Although an example where the winding 4 is constructed by the plate-shaped conductors 61 has been described above, it is also possible to use a winding 4 constructed by winding coated wires around the barrel-shaped portions 51.

Figure 14:
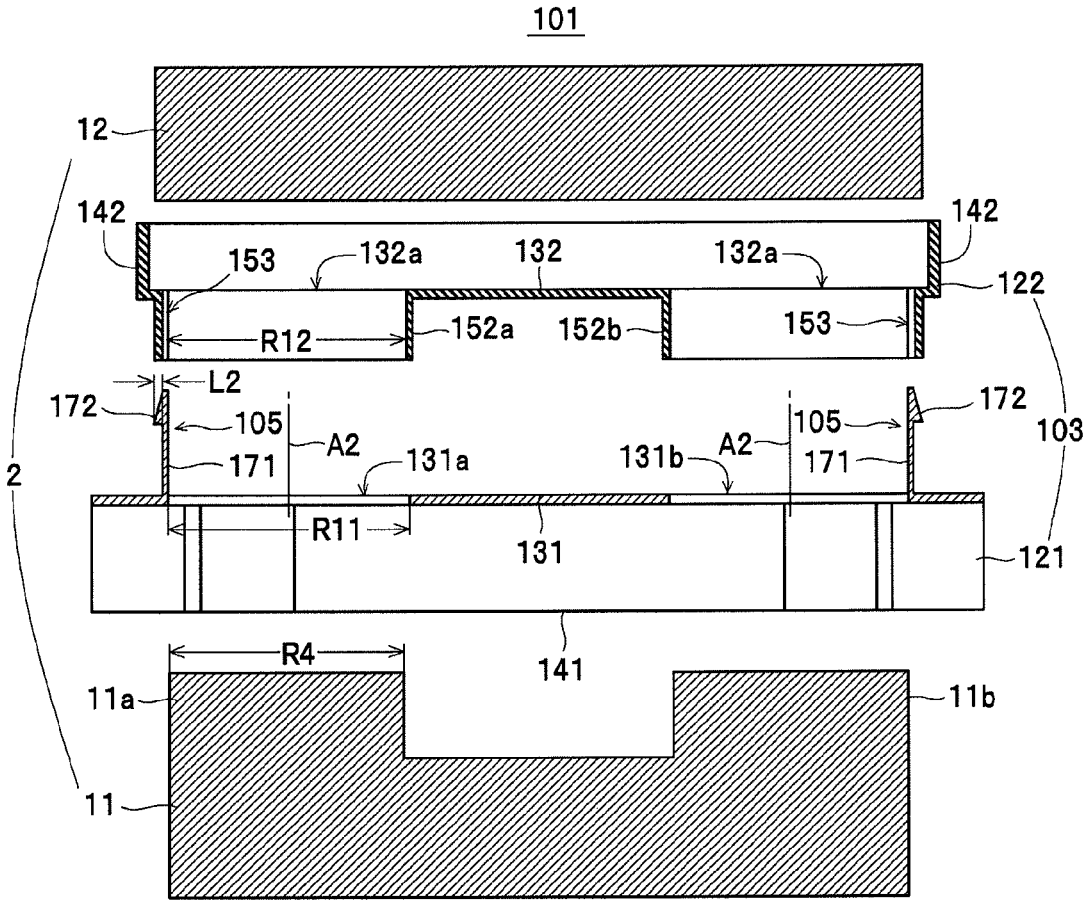
FIG. 14 is a cross-sectional view depicting the configuration of another winding component.

Next, the configuration of a winding component 101 depicted in FIG. 14 will be described as another example of a winding component according to the present invention. Note that in the following description, component elements that are the same as the winding component 1 described above are assigned the same reference numerals and duplicated description thereof is omitted. As depicted in FIG. 14, the winding component 101 includes the core member 2, a winding frame 103, the winding 4 (omitted from the drawing), and separation restricting portions 105.

As depicted in FIG. 14, the winding frame 103 includes a first winding frame member 121 and a second winding frame member 122 that are both formed of an insulating material (for example, resin) and are capable of being joined together. Note that in FIG. 14, a state is depicted where the first winding frame member 121 and the second winding frame member 122 have been cut along the length direction (a direction that is the same as the cutting direction in FIG. 6), one separation restricting portion 105 disposed at an edge of an opening 131*a* has been cut along a direction that passes a center in the width direction of the separation restricting portion 105 and the center axis A2 of the opening 131*a*, and one separation restricting portion 105 disposed at an edge of an opening 131*b* has been cut along a direction that passes a center in the width direction of the separation restricting portion 105 and the center axis A2 of an opening 131*b*.

As depicted in FIG. 14, the first winding frame member 121 includes a guard portion 131 formed as a rectangular plate, and side plates 141 that are erected on a pair of edges in the length direction of the guard portion 131 (in FIG. 14, only one of the side plates 141 is depicted). Two openings 131*a* and 131*b* that are circular and through which the pillar portions 11*a* and 11*b* of the first core member 11 of the core member 2 can be inserted are formed in the guard portion 131. Here, an inner diameter R11 of the openings 131*a* and 131*b* is set slightly larger than the outer diameter R4 of the pillar portions 11*a* and 11*b*. The inner diameter R11 of the openings 131*a* and 131*b* is also set so that the difference between the inner diameter R11 and the outer diameter R4 is smaller than a protruding length L2 of hook portions 172, described later, of the separation restricting portions 105. Also, for the first winding frame member 121, unlike the first winding frame member 21 of the winding component 1 described above, a configuration where barrel-shaped portions are not formed at the edges of the openings 131*a* and 131*b* is used.

As depicted in FIG. 14, the second winding frame member 122 includes a guard portion 132 formed as a rectangular plate, and side plates 142 that are erected on the edges of the guard portion 132 (in FIG. 14, only one of the side plates 142 is depicted). Two openings 132*a* and 132*b* that are circular and through which the pillar portions 11*a* and 11*b* of the first core member 11 of the core member 2 can be inserted are formed in the guard portion 132. Barrel-shaped portions 152*a* and 152*b* into which the pillar portions 11*a* and 11*b* of the first core member 11 can be inserted are respectively formed on the edges of the openings 132*a* and 132*b* of the guard portion 132. Here, an inner diameter R12 of the barrel-shaped portions 152*a* and 152*b* is set at the same size as the inner diameter R11 of the openings 131*a* and 131*b* of the first winding frame member 121. Channels 153 are also formed in the inner circumferential surfaces of the barrel-shaped portions 152*a* and 152*b*. In a state where the first winding frame member 121 and the second winding frame member 122 are joined, plate-shaped portions 171, described later, of the separation restricting portions 105 inserted inside the barrel-shaped portions 152*a* and 152*b* fit inside the channels 153 which function so as to prevent height differences from being produced on the inner circumferential surfaces of the barrel-shaped portions 152*a* and 152*b*.

The separation restricting portions 105 are members that restrict separation of the first winding frame member 121 and the second winding frame member 122 in the joined state, and as depicted in FIG. 14, are disposed on the first winding frame member 121. Here, four separation restricting portions 105 are disposed on the winding component 101 (in FIG. 14, only two separation restricting portions 105 are depicted). Each separation restricting portion 105 includes a plate-shaped portion 171 and a hook portion 172.

As depicted in FIG. 14, the plate-shaped portions 171 are disposed on the guard portion 131 of the first winding frame member 121 so as to protrude from the edges of the openings 131*a* and 131*b* in the guard portion 131 toward the second winding frame member 122 ("one of the winding frame members" in the joined state) in a direction perpendicular to the guard portion 131 (upward in FIG. 14). Each plate-shaped portion 171 is formed of the same material (resin) as the first winding frame member 121 and in the shape of a plate that is integrated with the first winding frame member 121, and is capable of elastic deformation in a direction toward and away from the center axes A2 of the openings 131*a* and 131*b* of the first winding frame member 121. As depicted in FIG. 14, the plate-shaped portions 171 are formed thinner than the thickness of the barrel-shaped portions 152*a* and 152*b* of the second winding frame member 122 and are configured so that in a state where the plate-shaped portions 171 have been inserted inside the barrel-shaped portions 152*a* and 152*b* (a state where the plate-shaped portions 171 have been fitted into the channels 153 in the barrel-shaped portions 152*a* and 152*b*), the inner surfaces of the plate-shaped portions 171 are flush with the inner circumferential surfaces of the barrel-shaped portions 152*a* and 152*b*.

As depicted in FIG. 14, each hook portion 172 is formed on a front end of a plate-shaped portion 171 so as to protrude in a (outward) direction from the center axes A2 of the openings 131*a* and 131*b*. Here, as depicted in FIG. 14, the protruding length L2 of a hook portion 172 from the outer surface of the plate-shaped portion 171 is set so as to be larger than a length produced by subtracting the outer diameter R4 of the pillar portions 11*a* and 11*b* of the first core member 11 of the core member 2 from the inner diameter R12 of the barrel-shaped portions 152*a* and 152*b* of the second winding frame member 122, that is, larger than the maximum width of the gap between the inner circumferential surfaces of the barrel-shaped portions 152*a* and 152*b* and the outer circumferential surfaces of the pillar portions 11*a* and 11*b* when the pillar portions 11*a* and 11*b* have been inserted inside the barrel-shaped portions 152*a* and 152*b*.

With the winding component 101, when joining the first winding frame member 121 and the second winding frame member 122, the second winding frame member 122 is brought close to the first winding frame member 121 so that the separation restricting portions 105 disposed on the first winding frame member 121 are inserted inside the barrel-shaped portions 152*a* and 152*b* of the second winding frame member 122. At this time, the hook portions 172 of the separation restricting portions 105 are pressed by the barrel-shaped portions 152*a* and 152*b* in a (inward) direction toward the center axes A2 of the openings 131*a* and 131*b* and as a result the plate-shaped portions 171 of the separation restricting portions 105 elastically deform in this direction. The second winding frame member 122 is then brought closer to the first winding frame member 121 and when the hook portions 172 become positioned on the rear surface side of the guard portion 132 (the opposite side to the side where the barrel-shaped portions 152*a* and 152*b* are formed), the plate-shaped portions 171 spring back in a (outward) direction away from the center axes A2 so that the hook portions 172 move in this direction. As a result, the hook portions 172 engage the edges of the openings 132*a* and 132*b* of the guard portion 132. By doing so, the first winding frame member 121 and the second winding frame member 122 are joined and separation of the first winding frame member 121 and the second winding frame member 122 in this joined state is restricted by the separation restricting portions 105.

Also, with the winding component 101, when the pillar portions 11*a* and 11*b* of the first core member 11 of the core member 2 have been inserted in the openings 131*a* and 131*b* of the first winding frame member 121 and the barrel-shaped portions 152*a* and 152*b* of the second winding frame member 122, a state where the inner surfaces of the plate-shaped portions 171 of the separation restricting portions 105 and the outer circumferential surfaces of the pillar portions 11*a* and 11*b* are adjacent (one example of "one state out of a contacting state and an adjacent state") is maintained. Here, as described above, the inner diameter R12 of the barrel-shaped portions 152*a* and 152*b* is set equal to the inner diameter R11 of the openings 131*a* and 131*b*, that is, slightly larger than the outer diameter R4 of the pillar portions 11*a* and 11*b*. This means that by inserting the pillar portions 11*a* and 11*b* of the first core member 11 in the barrel-shaped portions 152*a* and 152*b*, a state where the inner surfaces of the plate-shaped portions 171 and the outer circumferential surfaces of the pillar portions 11*a* and 11*b* are adjacent is maintained. As a result, elastic deformation of the plate-shaped portions 171 in a direction toward the center axes A2 of the openings 131*a* and 131*b* is restricted, which reliably prevents a situation where engagement of the hook portions 172 on the edges of the openings 132*a* and 132*b* of the guard portion 132 is released (a situation where the hook portions 172 come off the edges). This makes it possible to reliably maintain the joined state of the first winding frame member 121 and the second winding frame member 122.

Also, as described above, the protruding length L2 of the hook portions 172 from the outer surface of the plate-shaped portions 171 is set larger than a length produced by subtracting the outer diameter R4 of the pillar portions 11*a* and 11*b* from the inner diameter R12 of the barrel-shaped portions 152*a* and 152*b*, that is, larger than the maximum width of the gap between the inner circumferential surfaces of the barrel-shaped portions 152*a* and 152*b* and the outer circumferential surfaces of the pillar portions 11*a* and 11*b*. This means that it is possible, even when the first core member 11 moves relative the second winding frame member 122 by the maximum width of the gap between the inner circumferential surfaces of the barrel-shaped portions 152*a* and 152*b* and the outer circumferential surfaces of the pillar portions 11*a* and 11*b* and/or the plate-shaped portions 171 elastically deform in a direction toward the center axes A2 of the openings 131*a* and 131*b* by this maximum width, to reliably prevent a situation where engagement of the hook portions 172 on the edges of the openings 132*a* and 132*b* of the guard portion 132 is released (a situation where the hook portions 172 come off the edges).

In this way, the winding component 101 includes the separation restricting portions 105 that are equipped with the plate-shaped portions 171 constructed so as to be capable of elastic deformation in a direction toward the center axes A2 of the openings 131*a* and 131*b* and the hook portions 172 formed on the front ends of the plate-shaped portions 171 so as to protrude in a direction away from the center axes A2, that are disposed on edges of the openings 131*a* and 131*b* of the guard portion 131 and configured to restrict separation of the first winding frame member 121 and the second winding frame member 122 in the joined state, and are configured so that a state where the plate-shaped portions 171 and the pillar portions 11*a* and 11*b* that have been inserted in the barrel-shaped portions 152*a* and 152*b* are adjacent is maintained and elastic deformation of the plate-shaped portions 171 in a direction toward the center axes A2 is restricted. For this reason, according to the winding component 101, since it is possible to reliably prevent the engagement of the hook portions 172 on the second winding frame member 122 from being released, it is possible to reliably maintain the joined state of the first winding frame member 121 and the second winding frame member 122. Also, according to the winding component 101, by disposing the separation restricting portions 105 on the edges of the openings 131*a* and 131*b* of the guard portion 131 of the first winding frame member 121 on which barrel-shaped portions are not formed, it is possible to have the hook portions 172 formed on the front ends of the plate-shaped portions 171 of the separation restricting portions 105 engage the second winding frame member 122 (that is, the edges of the openings 132*a* and 132*b*) by merely inserting the separation restricting portions 105 into the barrel-shaped portions 152*a* and 152*b* of the second winding frame member 122 when joining the first winding frame member 121 and the second winding frame member 122. This means that it is possible to easily assemble the winding component 101 and to sufficiently raise the efficiency with which the winding component 101 can be assembled.

Note that although in the winding component 101 described above, the second winding frame member 122 is set as "one of the winding frame members" for the present invention and the first winding frame member 121 is set as "another of the winding frame members" for the present invention, it is also possible to set the first winding frame member 121 as "one of the winding frame members" and to set the second winding frame member 122 as "another of the winding frame members". When setting the frame members in this way, the barrel-shaped portions 152*a* and 152*b* are formed on the first winding frame member 121 and the separation restricting portions 105 are disposed on the second winding frame member 122.

For the winding component 101, in place of the winding 4 constructed of the plate-shaped conductors 61, it is also possible to use a winding 4 constructed by winding coated wires around the barrel-shaped portions 152*a* and 152*b*.

Figure 15:
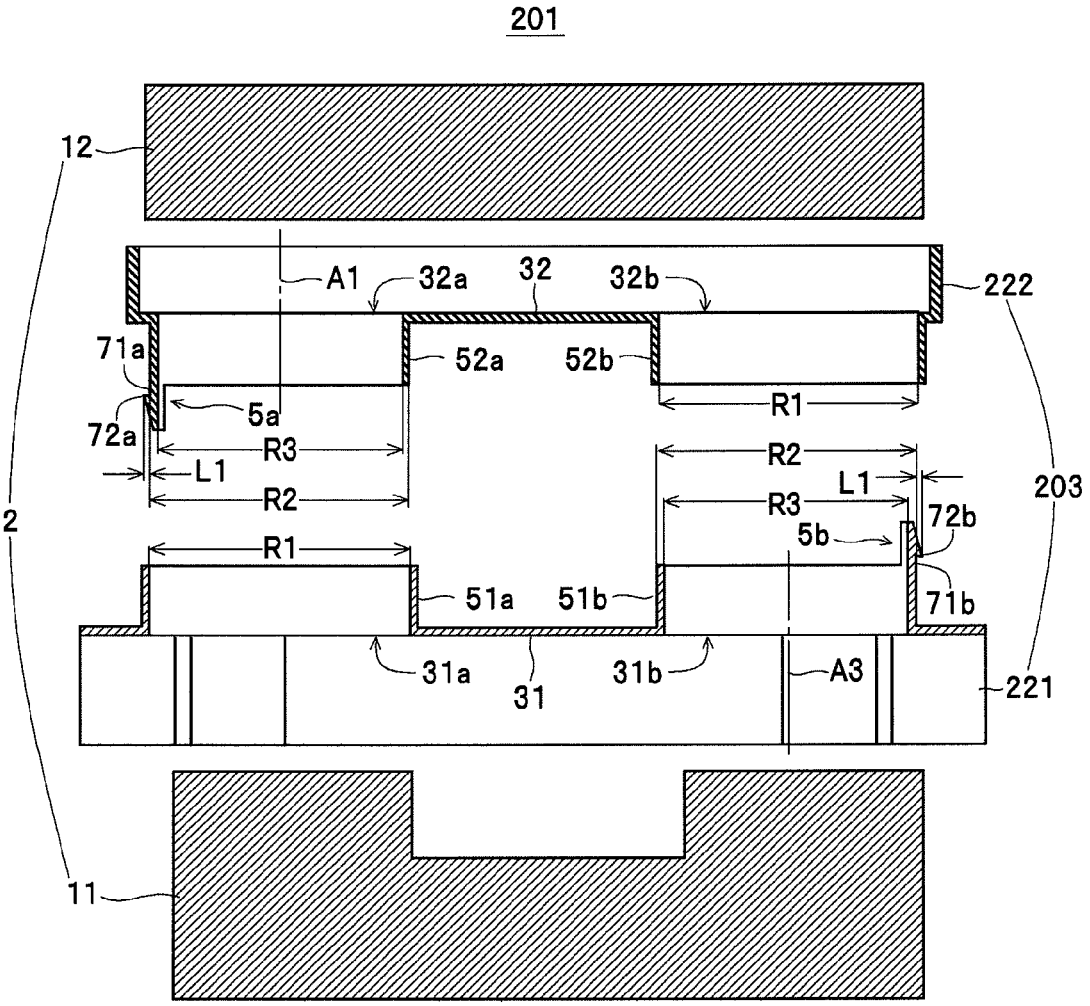
FIG. 15 is a cross-sectional view depicting the configuration of another winding component.

Next, the configuration of a winding component 201 depicted in FIG. 15 will be described as another example of a winding component. Note that in the following description, component elements that are the same as the winding components 1 and 101 described above are assigned the same reference numerals and duplicated description thereof is omitted. As depicted in FIG. 15, the winding component 201 includes the core member 2, a winding frame 203, the winding 4 (omitted from the drawing), and separation restricting portions 5*a* and 5*b*. Here, the separation restricting portion 5*a* corresponds to a "first separation restricting portion" for the present invention and the separation restricting portion 5*b* corresponds to a "second separation restricting portion" for the present invention. Note that in FIG. 15, a state is depicted where the first winding frame member 221 and the second winding frame member 222 have been cut along the length direction (a direction that is the same as the cutting direction in FIG. 6), one separation restricting portion 5*a* disposed on the barrel-shaped portion 52*a* has been cut along a direction that passes a center in the width direction of the separation restricting portion 5*a* and the center axis A1 of the barrel-shaped portion 52*a*, and one separation restricting portion 5*b* disposed on the barrel-shaped portion 51*b* has been cut along a direction that passes a center in the width direction of the separation restricting portion 5*b* and the center axis A3 of a barrel-shaped portion 51*b*.

As depicted in FIG. 15, the winding frame 203 includes a first winding frame member 221 (that corresponds to "another of the winding frame members" for the present invention) and a second winding frame member 222 (that corresponds to "one of the winding frame members" for the present invention) that are both formed of an insulating material (such as resin) and can be joined together.

As depicted in FIG. 15, in the same way as the first winding frame member 21 of the winding component 1 described above, the first winding frame member 221 includes the guard portion 31 in which the two openings 31*a* and 31*b* are formed, the side plates 41*a* and 41*b*, and the barrel-shaped portions 51*a* and 51*b* formed on the edges of the openings 31*a* and 31*b* of the guard portion 31. Here, the barrel-shaped portion 51*a* is formed with the same shape (the same dimensions) as the barrel-shaped portion 51*a* of the winding component 1 described above, and the barrel-shaped portion 51*b* is formed with the same shape (the same dimensions) as the barrel-shaped portion 52*b* of the second winding frame member 22 of the winding component 1 described above. That is, aside from the barrel-shaped portion 51*b*, the first winding frame member 221 is configured in the same way as the first winding frame member 21 of the winding component 1 described above.

As depicted in FIG. 15, in the same way as the second winding frame member 22 of the winding component 1 described above, the second winding frame member 222 includes the guard portion 32 in which the two openings 32*a* and 32*b* are formed, the side plates 42*a* to 42*d*, and the barrel-shaped portions 52*a* and 52*b* formed on the edges of the openings 32*a* and 32*b* in the guard portion 32. Here, the barrel-shaped portion 52*a* is formed in the same shape (with the same dimensions) as the barrel-shaped portion 52*a* of the winding component 1 described above and the barrel-shaped portion 52*b* is formed in the same shape (with the same dimensions) as the barrel-shaped portion 51*b* of the first winding frame member 21 of the winding component 1 described above. That is, aside from the barrel-shaped portion 52*b*, the second winding frame member 222 is configured in the same way as the second winding frame member 22 of the winding component 1 described above.

As depicted in FIG. 15, each separation restricting portion 5*a* includes the plate-shaped portion 71*a* (which corresponds to a "first plate-shaped portion" for the present invention) and a hook portion 72*a* (which corresponds to a "first hook portion" for the present invention) and is disposed on the front end of the barrel-shaped portion 52*a* of the second winding frame member 222. In this example, two separation restricting portions 5*a* are disposed on the winding component 201. Also, the plate-shaped portions 71*a* and the hook portions 72*a* of the separation restricting portions 5*a* are configured in the same way as the plate-shaped portions 71 and the hook portions 72 of the separation restricting portions 5 (see FIG. 6) of the winding component 1 described above.

As depicted in FIG. 15, the separation restricting portion 5*b* includes the plate-shaped portion 71*b* (which corresponds to a "second plate-shaped portion" for the present invention) and a hook portion 72*b* (which corresponds to a "second hook portion" for the present invention).

As depicted in FIG. 15, the plate-shaped portions 71*b* are formed in the same shape as the plate-shaped portions 71*a* of the separation restricting portions 5*a* and are disposed on the front end of the barrel-shaped portion 51*b* so as to protrude from the front end of the barrel-shaped portion 51*b* (which, except for one part, corresponds to a barrel-shaped portion disposed on an edge of an opening in the "other winding frame member" that faces the other opening (i.e., the opening where the first separation restricting portions are not provided) in the "one of the winding frame members") of the first winding frame member 221 toward the second winding frame member 222 (the "one of the winding frame members") in a direction (upward in FIG. 15) that is perpendicular to the guard portion 31.

As depicted in FIG. 15, the hook portions 72*b* are formed in the same shape as the hook portions 72*a* of the separation restricting portions 5*a* and are formed on the front ends of the plate-shaped portions 71*b* so as to protrude in a direction away from the center axis A3 of the opening 31*b*.

With the winding component 201, when joining the first winding frame member 221 and the second winding frame member 222, the separation restricting portions 5*a* disposed on the front end of the barrel-shaped portion 52*a* of the second winding frame member 222 are inserted inside the barrel-shaped portion 51*a* of the first winding frame member 221 and the separation restricting portions 5*b* disposed on the front end of the barrel-shaped portion 51*b* of the first winding frame member 221 are inserted inside the barrel-shaped portion 52*b* of the second winding frame member 222. Next, the first winding frame member 221 and the second winding frame member 222 are brought closer together so that the barrel-shaped portion 52*a* is inserted inside the barrel-shaped portion 51*a* and the barrel-shaped portion 51*b* is inserted inside the barrel-shaped portion 52*b*. When doing so, the hook portions 72*a* of the separation restricting portions 5*a* engage the edge of the insertion hole 31*a* in the guard portion 31 of the first winding frame member 221 and the hook portions 72*b* of the separation restricting portions 5*b* engage the edge of the insertion hole 32*b* in the guard portion 32 of the second winding frame member 222. By doing so, the first winding frame member 221 and the second winding frame member 222 are joined and separation of the first winding frame member 221 and the second winding frame member 222 in the joined state is restricted.

Also, with the winding component 201, when the pillar portions 11*a* and 11*b* have been inserted into the barrel-shaped portions 51*a* and 51*b* of the first winding frame member 221 and the barrel-shaped portions 52*a* and 52*b* of the second winding frame member 222, a state where the inner surfaces of the plate-shaped portions 71*a* and 71*b* of the separation restricting portions 5*a* and 5*b* and outer circumferential surfaces of the pillar portions 11*a* and 11*b* are adjacent is maintained. As a result, elastic deformation of the plate-shaped portions 71*a* and 71*b* in a direction toward the center axes A1 and A3 is restricted and a situation where the engagement of the hook portions 72*a* and 72*b* is released is reliably prevented, so that it is possible to reliably maintain the joined state of the first winding frame member 221 and the second winding frame member 222.

According to the winding component 201, by disposing the separation restricting portions 5*a* on the front end of the barrel-shaped portion 51*b* of the first winding frame member 221 and disposing the separation restricting portions 5*b* on the front end of the barrel-shaped portion 52*a* of the second winding frame member 222, since it is possible, when a force is applied in a direction where the first winding frame member 221 and the second winding frame member 222 become separated, to distribute such force with favorable balance between the separation restricting portions 5*a* and 5*b*, it is possible to reliably prevent a situation where the engagement of the hook portions 72*a* and 72*b* is released.

What is claimed is:

1. A winding component comprising:

a core member;

a winding frame disposed in a vicinity of the core member; and a winding formed by one or more conductors that wind around the winding frame, wherein the winding frame includes a pair of winding frame members which are configured so as to be capable of being joined together, which each have an opening through which the core member is inserted formed therein, and each have a guard portion provided so that the guard portions face each other in a joined state which is produced when the winding frame members are joined together, a barrel-shaped portion, which is disposed on an edge of the opening and is capable of having the core member inserted thereinto, is formed on one of the winding frame members, the one of the winding frame members is equipped with a first separation restricting portion that restricts separation of the winding frame members in the joined state and includes: a first plate-shaped portion which is disposed so as to protrude from a front end of the barrel-shaped portion toward the other winding frame member in a direction perpendicular to the guard portion and which is capable of elastic deformation in a direction toward and away from a center axis of the opening; and a first hook portion that is formed on a front end of the first plate-shaped portion so as to protrude in a direction away from the center axis and engages the other winding frame member in the joined state, and the first separation restricting portion is configured so that one state out of a contacting state and an adjacent state between the first plate-shaped portion and the core member is maintained when the core member has been inserted into the barrel-shaped portion and elastic deformation of the first plate-shaped portion in a direction toward the center axis is restricted.

2. The winding component according to claim 1, wherein a plurality of openings that face one another in the joined state are formed in the pair of winding frame members, the barrel-shaped portion on which the first separation restricting portion is provided is disposed on an edge of one or more openings out of the plurality of openings in the one winding frame member, the barrel-shaped portion is provided on an edge of each opening of the other winding frame member that faces openings of the one winding frame member aside from the one or more openings, a second separation restricting portion is disposed on the other winding frame member, the second separation restricting portion restricting separation of the winding frame members in the joined state and including: a second plate-shaped portion that is disposed so as to protrude in a direction perpendicular to the guard portion from a front end of the barrel-shaped portion disposed on the other winding frame member toward the one winding frame member and is capable of elastic deformation toward and away from a center axis of the opening; and a second hook portion that is formed on a front end of the second plate-shaped portion so as to protrude in a direction away from the center axis and engages the one winding frame member in the joined state, and the second separation restricting portion is configured so that one state out of a contacting state and an adjacent state between the second plate-shaped portion and the core member is maintained when the core member has been inserted into the barrel-shaped portion and elastic deformation of the second plate-shaped portion in a direction toward a center axis is restricted.

3. The winding component according to claim 1, wherein the barrel-shaped portions are formed on both the winding frame members and are configured so that respective barrel-shaped portions are capable of being inserted in one another.

4. The winding component according to claim 2, wherein the barrel-shaped portions are formed on both the winding frame members and are configured so that respective barrel-shaped portions are capable of being inserted in one another.

5. A winding component comprising:

a core member;

a winding frame disposed in a vicinity of the core member; and a winding formed by one or more conductors that wind around the winding frame, wherein the winding frame includes a pair of winding frame members which are configured so as to be capable of being joined together, which each have an opening through which the core member is inserted formed therein, and each have a guard portion provided so that the guard portions face each other in a joined state which is produced when the winding frame members are joined together, a barrel-shaped portion, which is disposed on an edge of the opening and is capable of having the core member inserted thereinto, is formed on one of the winding frame members, another of the winding frame members is equipped with a separation restricting portion that restricts separation of the winding frame members in the joined state and includes: a plate-shaped portion which is disposed so as to protrude from an edge of the opening toward the one of the winding frame members in a direction perpendicular to the guard portion and which is capable of elastic deformation in a direction toward and away from a center axis of the opening; and a hook portion that is formed on a front end of the plate-shaped portion so as to protrude in a direction away from the center axis and engages the one of winding frame members in the joined state, and the separation restricting portion is configured so that one state out of a contacting state and an adjacent state between the plate-shaped portion and the core member is maintained when the core member has been inserted into the barrel-shaped portion and elastic deformation of the plate-shaped portion in a direction toward the center axis is restricted.

* * * * *